US012492879B2

(12) United States Patent
Deng

(10) Patent No.: US 12,492,879 B2
(45) Date of Patent: Dec. 9, 2025

(54) FOLDABLE SUPPORT BENCH

(71) Applicant: Guangdong Laitu Imaging Technology Co., Ltd., Zhongshan (CN)

(72) Inventor: Tongling Deng, Zhongshan (CN)

(73) Assignee: Guangdong Laitu Imaging Technology Co., Ltd., Zhongshan (CN)

( * ) Notice: Subject to any disclaimer, the term of this patent is extended or adjusted under 35 U.S.C. 154(b) by 443 days.

(21) Appl. No.: 18/313,690

(22) Filed: May 8, 2023

(65) Prior Publication Data

US 2024/0377154 A1 Nov. 14, 2024

(51) Int. Cl.
*F41A 23/02* (2006.01)

(52) U.S. Cl.
CPC ..... *F41A 23/02* (2013.01)

(58) Field of Classification Search
CPC ..... F41A 23/02
See application file for complete search history.

(56) References Cited

U.S. PATENT DOCUMENTS 2,587,177 A * 2/1952 Larson ..... B25H 1/04 144/286.1
2,868,598 A * 1/1959 Karoff ..... A47B 3/083 108/174
4,501,082 A * 2/1985 Phillips ..... F41A 23/00 42/94
4,535,559 A * 8/1985 Hall ..... F41A 23/14 42/94
5,887,531 A * 3/1999 Covill ..... A47B 3/083 108/174
6,286,824 B1 * 9/2001 Sagol ..... B25H 1/04 269/900
7,293,751 B2 * 11/2007 Eriksson ..... A47B 23/002 411/389
9,648,947 B2 * 5/2017 Wetzstein ..... F16M 11/28
11,312,000 B2 * 4/2022 Sun ..... B25B 11/00

* cited by examiner

*Primary Examiner* — Anita M King
(74) *Attorney, Agent, or Firm* — Wang Law Firm, Inc.

(57) ABSTRACT

The present invention discloses a foldable support bench comprising a support plate and a base. The support plate is provided with at least one piece, and the support plate is hingedly provided on the base. The base is provided with at least one first threaded connection hole, and the support plate is provided with at least one second threaded connection hole. In the present invention, the support plate is rotatable relative to the base. During use, the support plate is expanded relative to the base, allowing the two to be in a parallel state. When not in use, the support plate is rotated and folded relative to the base, and the two are in a perpendicular state to each other. Compared to existing technology, the present invention has the advantages of a simple and reasonable structure, foldability, reduced storage space, and ease of storage and transportation.

13 Claims, 7 Drawing Sheets

FOLDABLE SUPPORT BENCH

FIELD OF THE INVENTION

The present invention relates to a foldable support bench.

BACKGROUND OF THE INVENTION

A support bench is a platform used in gun shooting to support firearms, bows, telescopes, and other components.

The existing support platform is a one-piece plate structure that cannot be folded and stored. Even when not in use, it cannot be folded or reduced in size, resulting in it occupying a large storage space when stored and transported. This creates inconvenient transporting and storage problems.

SUMMARY OF THE INVENTION

The present invention aims to solve at least one of the technical problems existing in the prior art. To this end, the present invention proposes a foldable, reduced storage space, easy to store and transport support bench.

A foldable support bench designed for this purpose comprises a support plate and a base, wherein the support plate has at least one piece, and the support plate is hingedly attached to the base. The base has at least one first threaded connection hole, and the support plate has at least one second threaded connection hole.

Preferably, the support plate has two pieces and is provided on the left and right sides of the base, respectively.

Preferably, the outer edge of the support plate has an upwardly projecting enclosure having a third threaded connection hole, and the enclosure also has a through slot for threading a strap.

Preferably, the bottom surface of the support plate has an external bracket that can slide with respect to the support plate. The external bracket has a fourth threaded connection hole, and the external bracket has a locking element for connecting with the support plate to achieve a locking purpose.

Preferably, the support plate has sliding grooves at intervals, the external bracket has sliding blocks at intervals, which moves in the sliding grooves. The external bracket also has longitudinally extending bar grooves that are parallel to the sliding grooves. A plurality of fifth threaded connection holes are arranged on the support plate above the bar grooves, and the plurality of fifth threaded connection holes are arranged in the same direction as the direction of movement of the external bracket. The locking element is composed of a locking bolt and a knob. The locking bolt is threaded through the bar groove to connect with any one of the fifth threaded connection holes, and the knob is closely attached to the bottom surface of the external bracket.

Preferably, a first spacer is provided between the knob and the external bracket.

Preferably, the base comprises a mounting part and at least one connection part, the number of connection parts corresponding to the support plates. The connection part is provided on the side facing the support plate. The left and right sides of the support plate are provided with connection lugs on the left and right sides of the connection part, respectively, and the connection lug is provided with shaft hole. The connection part is provided with a sixth threaded connection hole connected to the shaft hole, and a connection bolt is threaded into the shaft hole to connect with the sixth threaded connection hole.

Preferably, a second spacer is threaded on the connection bolts on the left and right sides of the connecting lugs, and a reed is provided between the second spacer and the end of the connection bolt, with the reed being threaded on the connection bolt.

Preferably, a positioning recess is provided on the upper surface of the connection part, a positioning part is provided on the support plate to be embedded in the positioning recess, and a restriction part is provided on the connection part to be attached to the bottom surface of the support plate.

The present invention has the advantages of a simple and reasonable structure, foldability, reduced storage space, and ease of storage and transport compared to the prior art. It comprises a support plate and a base, wherein the support plate is provided with at least one piece, and the support plate is hingedly provided on the base. The base is provided with at least one first threaded connection hole, and the support plate is provided with at least one second threaded connection hole. In the present invention, the support plate can be rotated relative to the base. During use, the support plate is expanded relative to the base so that the two are in a parallel state. When not in use, the support plate can be rotated and folded relative to the base, and the two are in a perpendicular state to each other. Compared to existing technology, the present invention has the advantages of a simple and reasonable structure, foldability, reduced storage space, and ease of storage and transport.

DESCRIPTION OF THE PREFERRED EMBODIMENTS

The following description of the present invention is accompanied by the illustrations and embodiments provided below.

Referring to FIGS. 1 to 7, this is a foldable support bench comprising a support plate 20 and a base 10. The support plate 20 has at least one piece and is hingedly attached to the base 10. The base 10 has at least one first threaded connection hole 110, and the support plate 20 has at least one second threaded connection hole 210.

Furthermore, the first threaded connection hole 110 has a plurality of holes with different hole diameters.

Furthermore, the second threaded connection hole 210 has a plurality of holes with different hole diameters.

The present invention uses a support plate that can rotate relative to the base. When in use, the support plate expands relative to the base to be parallel for use. When not in use, the support plate rotates and folds relative to the base, and the two are perpendicular to each other. Compared with existing technology, the present invention has the advantages of a simple and reasonable structure, foldability, space-saving, and easy storage and transportation.

Specifically, the first threaded connection hole 110 is used to connect to a support element such as a tripod.

Specifically, the second threaded connection hole 210 is used to connect with a telescope mount, camera head, and other components.

Figure 1:
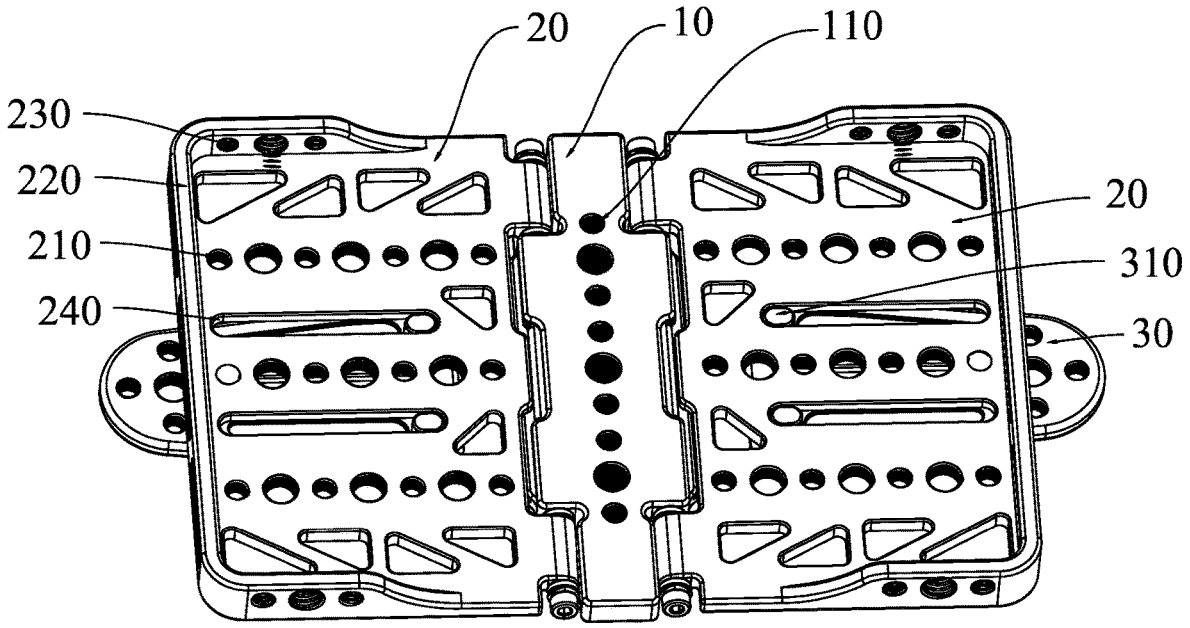
FIG. 1 is a schematic diagram of the three-dimensional structure of the present invention.
Figure 2:
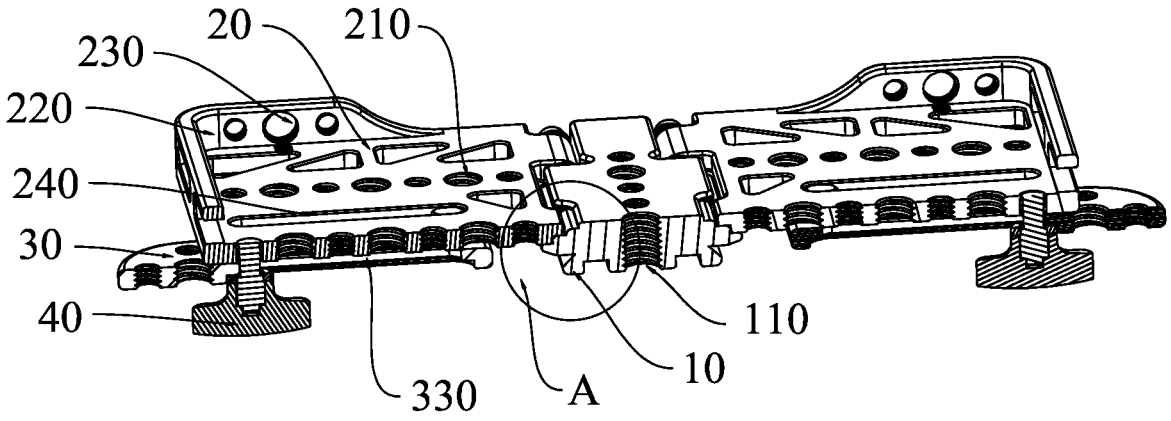
FIG. 2 is a schematic diagram of the cross-sectional structure of the present invention.

Specifically, as shown in FIG. 1, the support plate 20 has two pieces and is provided on the left and right sides of the base 10.

Figure 7:
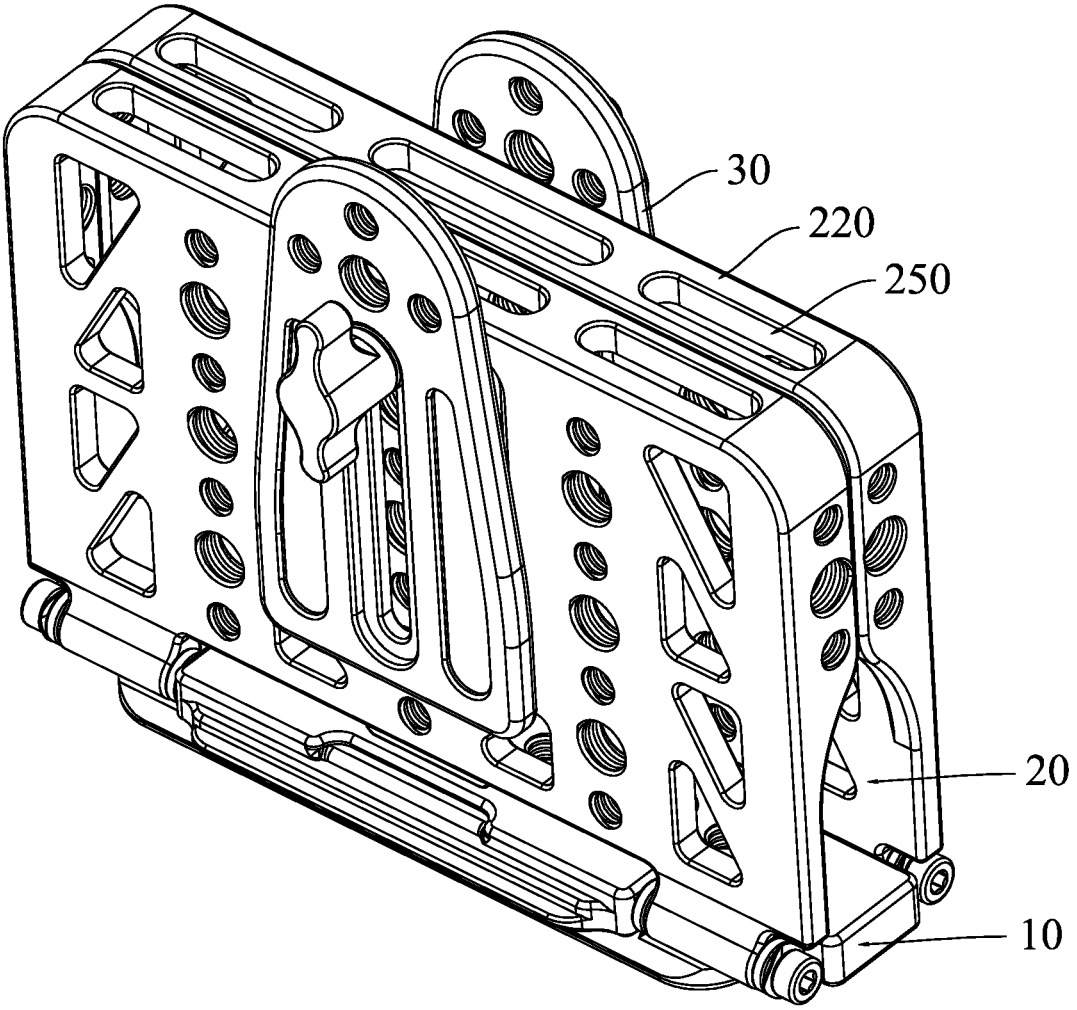
FIG. 7 is a schematic diagram of the structure of the present invention with the support plate and the base in the stowed state.

Referring to FIGS. 1 and 7, the support plate 20 has an upwardly projecting enclosure 220 at the outer edge, and the enclosure 220 has a third threaded connection hole 230. The enclosure 220 also has a through slot 250 for threading a strap.

Specifically, the third threaded connection hole 230 is used to further connect with a telescope mount, camera head, and other components to increase the expansion capability of this product to meet the needs of various external components.

Specifically, the through slot 250 is used to thread a strap that is used, for example, to tie down objects placed on the support bench.

Figure 4:
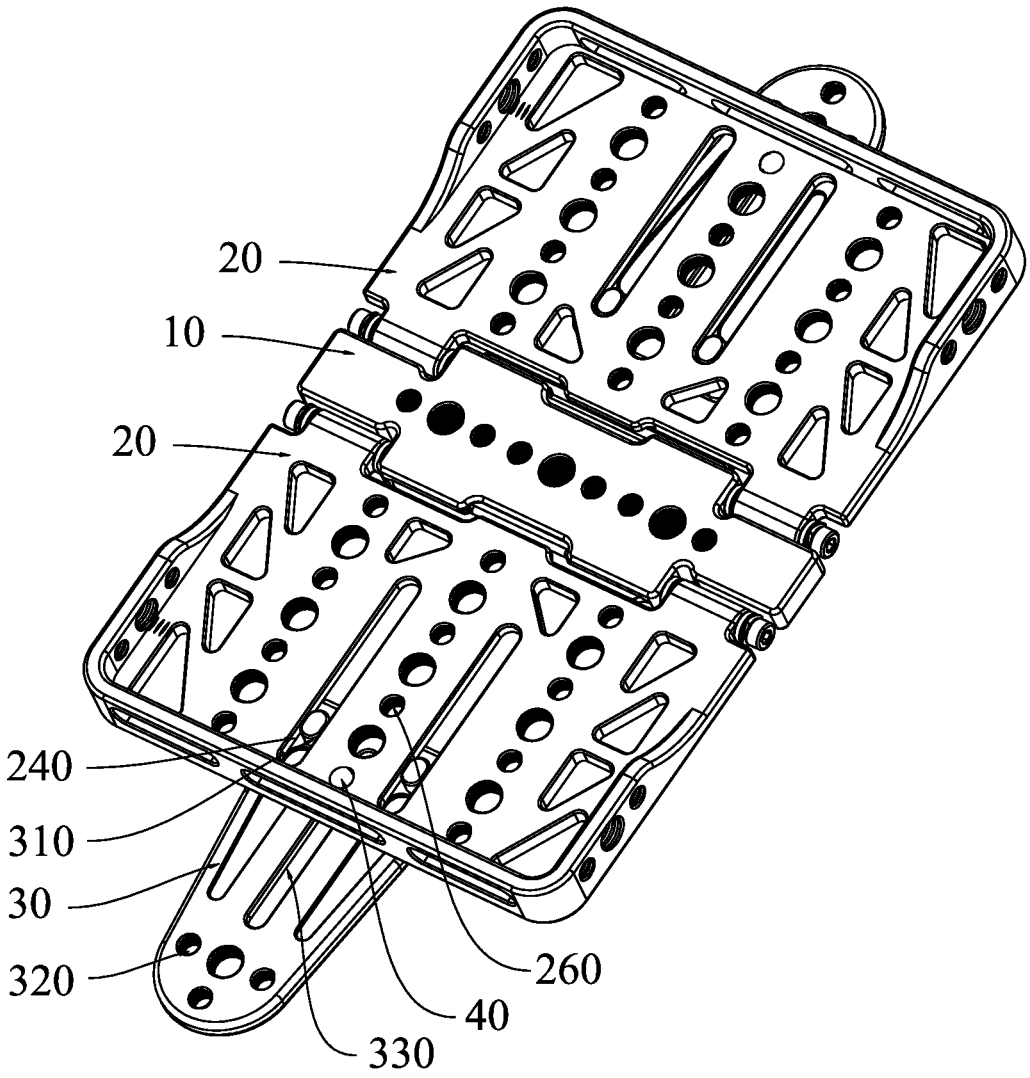
FIG. 4 is a schematic diagram of the three-dimensional structure of the present invention with the external bracket in the expanded state.

Referring to FIG. 4, the support plate 20 has an external bracket 30 on the bottom surface, which can slide relative to the support plate 20. The external bracket 30 has a fourth threaded connection hole 320 and a locking element 40 to connect to the support plate 20 to achieve a locking purpose.

The role of the external bracket 30 is to extend the use of the product outward for external telescope mounts, camera heads, and other components. It further increases the versatility of the product and can connect to a variety of components to increase its use.

The sliding external bracket 30 extends outward when in use. When not in use, it is stowed in the lower portion of the support plate 20 and takes up no space, making it easy to store and transport.

Referring to FIG. 4, the support plate 20 has sliding grooves 240 at intervals, and the external bracket 30 has sliding blocks 310 at intervals. The sliding block 310 moves in the sliding groove 240, and their cooperation can restrict the direction of movement of the external bracket 30 and the support plate 20 to ensure their relative stability;

The external bracket 30 is provided with longitudinally extending bar grooves 330 parallel to the sliding grooves 240. A plurality of fifth threaded connection holes 260 are arranged on the support plate 20 above the bar grooves 330. The plurality of fifth threaded connection holes 260 are arranged in the same direction as the direction of movement of the external bracket 30. The locking element 40 is composed of a locking bolt 410 and a knob 420. The locking bolt 410 is threadedly connected to any one of the fifth threaded connection holes 260 through the bar groove 330, and the knob 420 is closely attached to the bottom surface of the external bracket 30.

When the specific position of the external bracket 30 to be adjusted is required, turning the knob 420 loosens the locking bolt 410. Under this state, the knob 420 is separated from the bottom surface of the external bracket 30 so that the external bracket 30 can slide freely. When locking is required, turning the knob 420 tightens the locking bolt 410. The knob 420 is closely attached to the bottom surface of the external bracket 30 to clamp the external bracket 30 by the knob 420 and the support plate 20 and to restrict the position of the external bracket 30.

Specifically, the plurality of fifth threaded connection holes 260 are arranged in the same direction as the external bracket 30 moves, and the function is that when the external bracket 30 moves, the locking bolt 410 below selects a different fifth threaded connection hole 260 for screwing according to its movement to satisfy the function of the external bracket 30 moving outward.

Figure 5:
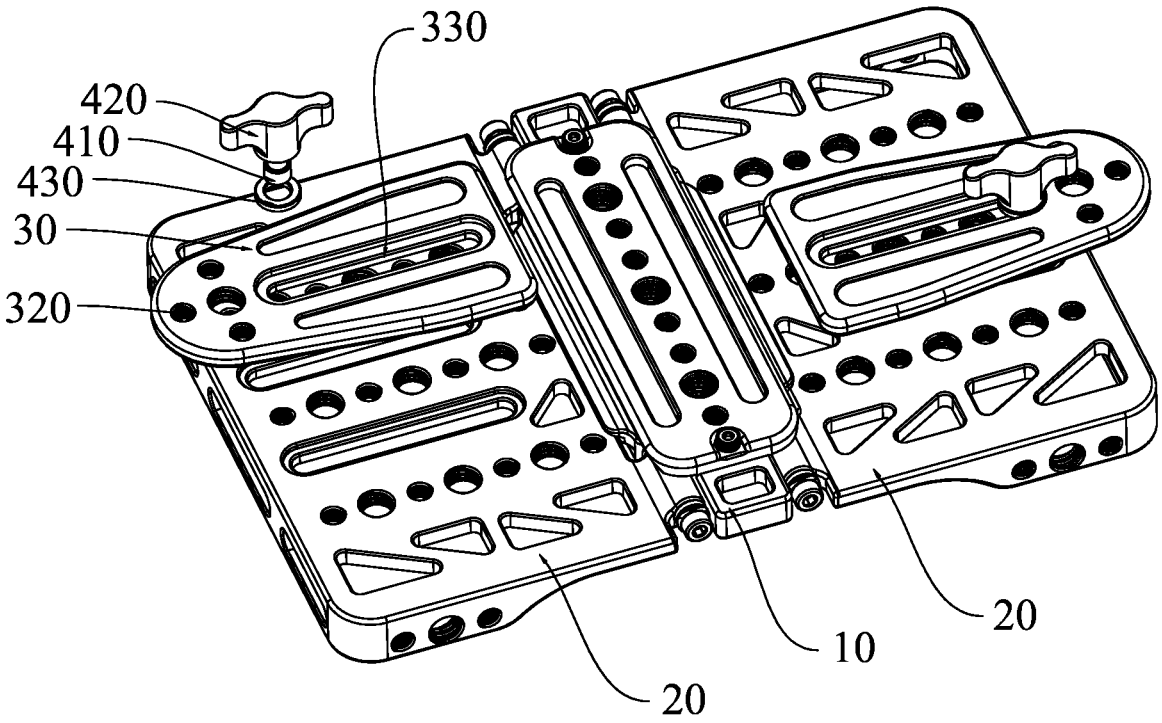
FIG. 5 is a first schematic diagram of the exploded structure of the present invention.

Referring to FIG. 5, a first spacer 430 is provided between the knob 420 and the external bracket 30. The first spacer 430 serves to increase the stability of the connection and to avoid the problem of loosening of the external bracket 30 due to the locking bolt 410 coming loose during shaking.

Figure 6:
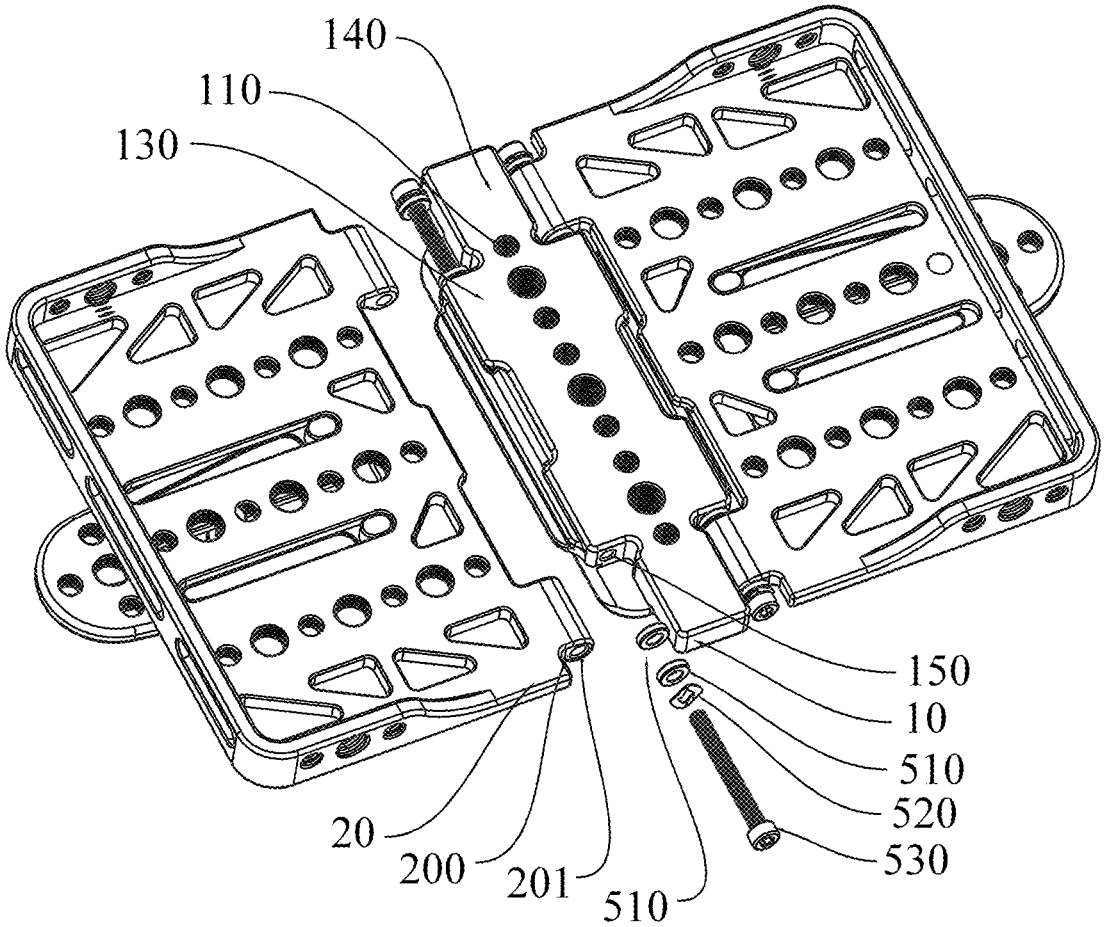
FIG. 6 is a second schematic diagram of the exploded structure of the present invention.

Referring to FIG. 6, the base 10 comprises a mounting part 140 and at least one connection part 130. The number of connection parts 130 corresponds to the support plates 20. The connection part 130 is provided on the side facing the support plate 20. The left and right sides of the support plate member 20 are provided with connection lugs 200 located on the left and right sides of the connection part 130, respectively. The connection lug 200 is provided with a shaft hole 201. The connection part 130 is provided with a sixth threaded connection hole 150 connected to the shaft hole 201, and a connection bolt 530 is threaded into the shaft hole 201 to connect with the sixth threaded connection hole 150. A second spacer 510 is threaded on the connection bolt 530 on the left and right sides of the connection lugs 200, and a reed 520 is provided between the second spacer 510 and the end of the connection bolt 530. The reed 520 is threaded on the connection bolt 530.

During assembly, the shaft hole 201 is aligned with the sixth threaded connection hole 150. Next, the reed 520 and the second spacer 510 are threaded onto the connection bolt 530, which is then threaded into the shaft hole 201. The second spacer 510 is then threaded onto the connection bolt 530, and the connection bolt 530 is screwed into the sixth threaded connection hole 150, allowing the connection lugs 200 to rotate relative to the connection part 130 with the connection bolt 530 as the axis.

Specifically, both the second spacer 510 and the reed 520 play a role in preventing loosening, which can effectively increase the stability of the connection and avoid the problem of loose connection bolts 530 during shaking and bumping.

Figure 3:
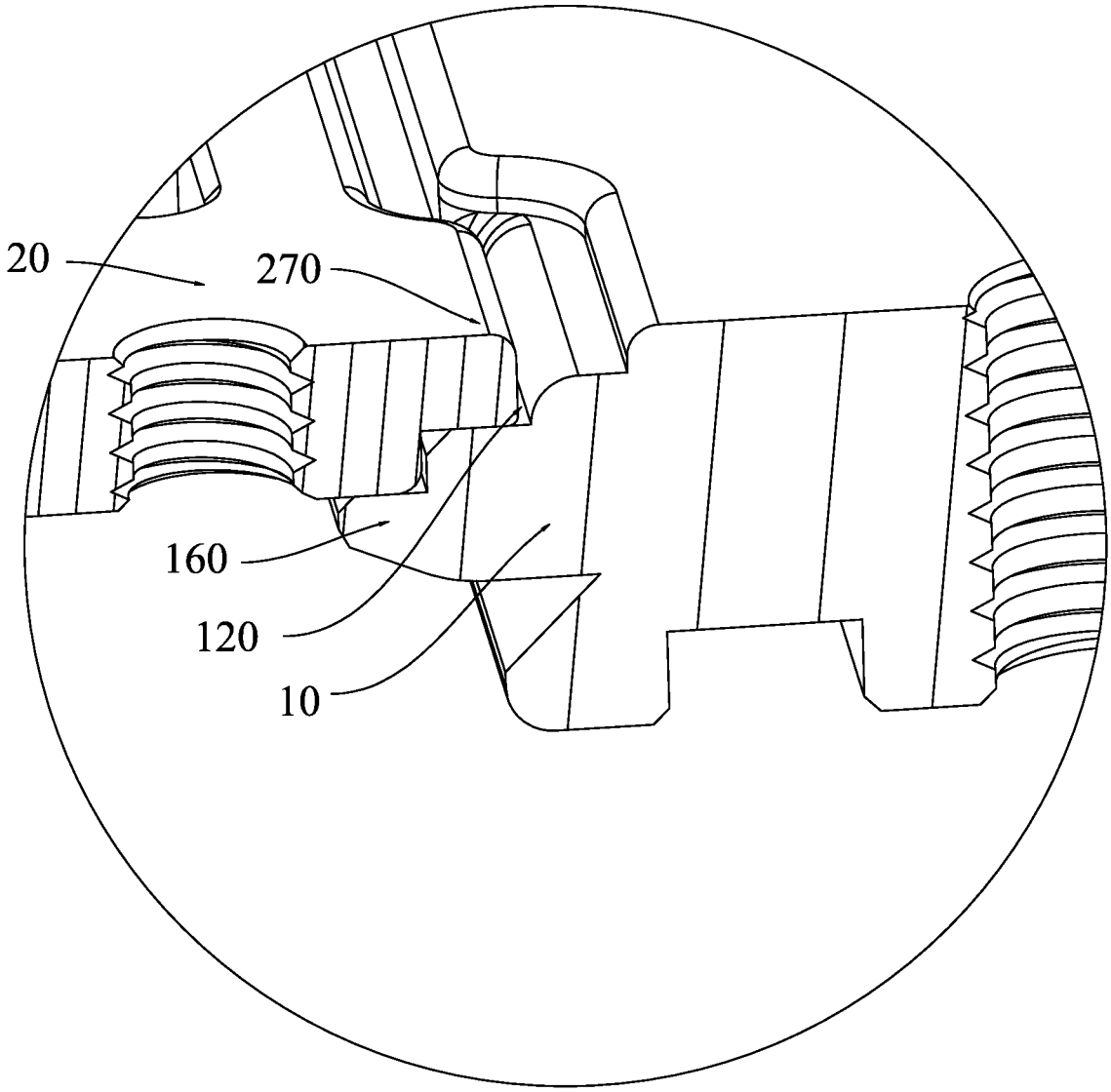
FIG. 3 is a schematic diagram of the enlarged structure at A in FIG. 2 of the present invention.

Referring to FIG. 3, a positioning recess 120 is provided on the upper surface of the connection part 130. A positioning part 270 is provided on the support plate 20, which is embedded in the positioning recess 120. A restriction part 160 is provided on the connection part 130 to be attached to the bottom surface of the support plate 20.

The mating constraint between the restriction part 160 and the positioning part 270 can ensure that the support plate 20 is in a state where it is parallel to the base 10 after expansion, as shown in FIG. 1.

What is not described in detail in this specification belongs to the prior art that is well known to those skilled in the art.

In the description of the present invention, it is to be understood that the terms "center", "longitudinal", "transverse", "length", "width", "thickness", "top", "bottom", "front", "back", "left", "right", "vertical", "horizontal", "top", "bottom", "inside", "outside", "clockwise", "counterclockwise" and the like indicate orientation or positional relationships based on those shown in the accompanying drawings and are intended only to facilitate and simplify the description of the present invention rather than indicating or implying that the equipment or components referred to must have a particular orientation, be constructed and operated in a particular orientation, and therefore cannot be construed as a limitation of the present invention. The terms "first" and "second" are used for descriptive purposes only and are not to be construed as indicating or implying relative importance or implicitly specifying the number of technical features indicated.

The above shows and describes the basic principles and main features of the present invention and the advantages of the present invention. A person skilled in the art should understand that the present invention is not limited by the above embodiments, and that the above embodiments and the description in the specification only illustrate the principles of the present invention, and that there will be various variations and improvements to the present invention without departing from the spirit and scope of the present invention, which fall within the scope of the present invention claimed for protection. The scope of protection claimed for the present invention is defined by the appended claims and their equivalents.

What is claimed is:

1. A foldable support bench comprising a support plate (20), wherein the support plate (20) further comprises a base (10), the support plate (20) has at least one piece and is hingedly attached to the base (10), the base (10) has at least one first threaded connection hole (110), the support plate (20) has at least one second threaded connection hole (210), the support plate (20) has an upwardly projecting enclosure (220) at an outer edge, the enclosure (220) has a third threaded connection hole (230), and the enclosure (220) has a through slot (250) for threading a strap.

2. The foldable support bench according to claim 1, characterized in that: the support plate (20) has two pieces and is provided on the left and right sides of the base (10) respectively.

3. The foldable support bench according to claim 1, characterized in that: the support plate (20) has an external bracket (30) on the bottom surface which slides relative to the support plate (20), the external bracket (30) has a fourth threaded connection hole (320) and a locking element (40) to connect to the support plate (20) to achieve a locking purpose.

4. The foldable support bench according to claim 3, characterized in that: the support plate (20) has sliding grooves (240) at intervals, and the external bracket (30) has sliding blocks (310) at intervals, the sliding blocks (310) moves in the sliding grooves (240); the external bracket (30) is provided with longitudinally extending bar grooves (330) parallel to the sliding grooves (240), a plurality of fifth threaded connection holes (260) are arranged on the support plate (20) above the bar grooves (330), the plurality of fifth threaded connection holes (260) are arranged in the same direction as the direction of movement of the external bracket (30); the locking element (40) is composed of a locking bolt (410) and a knob (420), wherein the locking bolt (410) is threadedly connected to any one of the fifth threaded connection holes (260) through the bar groove (330), and the knob (420) is closely attached to the bottom surface of the external bracket (30).

5. The foldable support bench according to claim 4, characterized in that: a first spacer (430) is provided between the knob (420) and the external bracket (30).

6. A foldable support bench comprising a support plate (20), wherein the support plate (20) comprises a base (10), the support plate (20) has at least one piece and is hingedly attached to the base (10), the base (10) has at least one first threaded connection hole (110), and the support plate (20) has at least one second threaded connection hole (210); the base (10) comprises a mounting part (140) and at least one connection part (130), the number of connection parts (130) corresponding to the support plates (20), the connection part (130) is provided on the side facing the support plate (20), the left and right sides of the support plate (20) are provided with connection lugs (200) located on the left and right sides of the connection part (130), respectively, and the connection lug (200) is provided with a shaft hole (201), the connection part (130) is provided with a sixth threaded connection hole (150) connected to the shaft hole (201), and a connection bolt (530) is threaded into the shaft hole (201) to connect with the sixth threaded connection hole (150).

7. The foldable support bench according to claim 6, characterized in that: a second spacer (510) is threaded on the connection bolt (530) on the left and right sides of the connection lugs (200), and a reed (520) is provided between the second spacer (510) and the end of the connection bolt (530), and the reed (520) is threaded on the connection bolt (530).

8. The foldable support bench according to claim 6, characterized in that: a positioning recess (120) is provided on the upper surface of the connection part (130); a positioning part (270) is provided on the support plate (20), which is embedded in the positioning recess (120); and a restriction part (160) is provided on the connection part (130) to be attached to the bottom surface of the support plate (20).

9. The foldable support bench according to claim 6, characterized in that: the support plate (20) has two pieces and is provided on the left and right sides of the base (10) respectively.

10. The foldable support bench according to claim 6, characterized in that: the support plate (20) has an upwardly projecting enclosure (220) at the outer edge, the enclosure (220) has a third threaded connection hole (230), and the enclosure (220) also has a through slot (250) for threading a strap.

11. The foldable support bench according to claim 6, characterized in that: the support plate (20) has an external bracket (30) on the bottom surface which slides relative to the support plate (20), the external bracket (30) has a fourth threaded connection hole (320) and a locking element (40) to connect to the support plate (20) to achieve a locking purpose.

12. The foldable support bench according to claim 11, characterized in that: the support plate (20) has sliding grooves (240) at intervals, and the external bracket (30) has sliding blocks (310) at intervals, the sliding blocks (310) moves in the sliding grooves (240); the external bracket (30) is provided with longitudinally extending bar grooves (330) parallel to the sliding grooves (240), a plurality of fifth threaded connection holes (260) are arranged on the support plate (20) above the bar grooves (330), the plurality of fifth threaded connection holes (260) are arranged in the same direction as the direction of movement of the external bracket (30); the locking element (40) is composed of a locking bolt (410) and a knob (420), wherein the locking bolt (410) is threadedly connected to any one of the fifth threaded connection holes (260) through the bar groove (330), and the knob (420) is closely attached to the bottom surface of the external bracket (30).

13. The foldable support bench according to claim 12, characterized in that: a first spacer (430) is provided between the knob (420) and the external bracket (30).

* * * * *